United States Patent [19]

Lindstrom et al.

[11] 4,435,304

[45] Mar. 6, 1984

[54] SULFUR BASED METAL CLEANERS

[75] Inventors: Merlin R. Lindstrom; Robert M. Parlman; James B. Kimble, all of Bartlesville, Okla.

[73] Assignee: Phillips Petroleum Company, Bartlesville, Okla.

[21] Appl. No.: 441,586

[22] Filed: Nov. 15, 1982

[51] Int. Cl.[3] ..... C11D 7/06

[52] U.S. Cl. ..... 252/156; 252/395; 252/545; 252/149

[58] Field of Search ..... 252/142, 146, 151, 156, 252/395, 545, 149; 260/455 B

[56] References Cited

U.S. PATENT DOCUMENTS

| | | | |
|---|---|---|---|
| 2,676,974 | 4/1954 | Crouch et al. | 260/455 B |
| 3,171,780 | 3/1965 | Mailen | 260/455 B |
| 3,180,790 | 3/1965 | Goodhue | 260/455 B |
| 3,551,499 | 12/1970 | Krockow | 260/455 B |
| 3,660,412 | 5/1972 | Haugwitz | 260/455 B |
| 4,215,140 | 6/1980 | Otto et al. | 260/455 B |

FOREIGN PATENT DOCUMENTS 863117 3/1961 United Kingdom .

*Primary Examiner*—John E. Kittle
*Assistant Examiner*—Hoa Van Le

[57] ABSTRACT

A novel aqueous metal cleaning composition consisting essentially of a Group IA or IIA metal hydroxide and at least one active metal cleaning ingredient of the formula

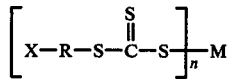

wherein R can be any hydrocarbylene radical having 1 to 6 carbon atoms, X is any H or OH, M is any group IA or IIA metal and n is the valence of M.

8 Claims, No Drawings

SULFUR BASED METAL CLEANERS

This invention relates to compositions used for the cleaning of metal surfaces.

The surface cleanliness of metal surfaces is known to influence the physical and chemical properties of that surface. The surfaces of most metallic articles of manufacture are covered either by a metal oxide due to oxidation, organic residues, if annealed, or protective oils applied during fabrication. It is known to those skilled in the art that it is advantageous to remove such coatings from the metal surface prior to subsequent processing such as, for example, prior to applying a desired coating thereon in order to obtain the maximum adherence of the coating to the metal surface.

Therefore, compositions which clean metal surfaces are highly desirable.

It is an object of this invention to provide novel compositions suitable for cleaning metal surfaces.

Other aspects, objects, and the several advantages of this invention will be obvious to one skilled in the art from the following description and from the appended claims.

In accordance with the present invention we have discovered an aqueous metal cleaning composition consisting essentially of a Group IA or IIA metal hydroxide and at least one active metal cleaning ingredient represented by the formula:

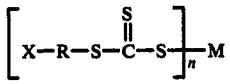

(I)

wherein R can be any hydrocarbylene radical having 1 to 6 carbon atoms, X is either H or OH, M is any group IA or IIA metal and n is the valence of M.

Examples of compounds according to formula (I) are:

sodium methyl trithiocarbonate
potassium methyl trithiocarbonate
sodium ethyl trithiocarbonate
sodium hexyl trithiocarbonate
cesium hexyl trithiocarbonate
sodium cyclohexyl trithiocarbonate
sodium hydroxymethyl trithiocarbonate
sodium 2-hydroxymethyl trithiocarbonate
sodium phenyl trithiocarbonate
calcium bis(ethyl trithiocarbonate)
magnesium bis(hexyl trithiocarbonate)
barium bis(hydroxymethyl trithiocarbonate)

and mixtures thereof.

Compounds represented by formula I are prepared by reacting a Group IA or IIA metal hydroxide, a $C_1$ to $C_6$ alkyl or hydroxyalkyl mercaptan and carbon disulfide in the presence of water.

In the aqueous cleaning composition of this invention, a Group IA or IIA metal hydroxide is present in the cleaning composition. In general, when the metal hydroxide is present in a cleaning composition, the composition will comprise from about 85.0 to about 99.65 wt. % water, from about 0.1 to about 5.0 wt. % Group I or IIA metal hydroxide, and from about 0.25 to about 10.0 wt. % of the active ingredient compound earlier disclosed.

In a further preferred embodiment of this invention, a water soluble surfactant is employed. Any water soluble anionic, nonionic or cationic surfactant can be used in the present invention. Examples of suitable agents are alkylbenzenesulfonates such as sodium dodecylbenzenesulfonate, petroleum sulfonates, phosphate esters, ethoxylated alkyl phenols and alcohols, such as octylphenoxypoly(ethyleneoxy) ethanol, carboxylic esters and amides, and amines and quaternary ammonium salts such as stearylbenzyldimethylammonium chloride. Generally, when the water soluble surfactant is present in a cleaning composition, the composition comprises from about 80.0 to 99.55 wt. % water, from about 0.1 to 5.0 wt. % water soluble surfactant, from about 0.1 to about 5.0 wt. % Group IA or IIA metal hydroxides, and from about 0.25 to about 10.0 wt. % of the active ingredient.

The following Examples further illustrate the present invention.

EXAMPLE I

Preparation of Sodium 2-Hydroxyethyl Trithiocarbonate and Ethyl Trithiocarbonate To a 3-neck 5-liter flask equipped with a stirrer and a dropping funnel was charged 2490 grams of water and 420 grams (10.5 moles) of sodium hydroxide. After the sodium hydroxide had been dissolved and the solution cooled to ambient room temperature there was slowly added with stirring a mixture of 780 grams (7.64 moles) of 2-mercaptoethanol and 760 grams (9.98 moles) of carbon disulfide. After the addition was complete, the solution was stirred for a few minutes and bottled. This aqueous mixture is estimated to contain 31.5 weight percent of the monosodium salt of 2-hydroxyethyltrithiocarbonic acid referred herein as sodium 2-hydroxyethyl trithiocarbonate.

Likewise sodium ethyl trithiocarbonate was prepared from 31 grams (0.5 mole) ethyl mercaptan, 22 grams (0.55 mole) sodium hydroxide, 38 grams (0.5 mole) carbon disulfide and 114 grams of water.

EXAMPLE II

Test Results

The test consists of immersing 1 inch×5 inches×0.400 inch steel, 1 inch×5 inches×0.35 inch brass, and 1 inch×5 inches×0.25 inch copper coupons into an aqueous cleaning solution containing 1 weight percent sodium hydroxide, or 1 weight percent surfactant (sodium alkylaryl polyether sulfonate), or 2 weight percent of the active sulfur-based ingredients such as sodium 2-hydroxyethyl trithiocarbonate and sodium ethyl trithiocarbonate, or combinations of all three. The solutions were heated to 90° F., 140° F., or 190° F. and stirred in an ultrasonic bath. The uncleaned metal coupons were periodically removed from the bath, rinsed in running tap water, visually rated for appearance, and evaluated for cleanliness by the water break-free test. This test is discussed in *Metal Finishing*, 45 (12), pg. 77, 78, 88 (1947), "Testing of Alkaline Metal Cleaners" by A. Mankowich and *Organic Finishing*, "Method of Evaluating Alkali Cleaners", 1946, pg. 9 by C. Nielson. Water break-free test means the surface remains water-wetted without breaking away. At this point the surface is considered clean. The surfaces were also examined for general cleaning in addition to water-free. Using the procedure described, the compounds, sodium 2-hydroxyethyl trithiocarbonate and sodium ethyl trithiocarbonate were evaluated as active ingredients in a typical aqueous cleaning solution.

The data from these tests is given in Table I.

TABLE I

Effect of Sodium 2-Hydroxyethyl Trithiocarbonate (HTTC) and Sodium Ethyl Trithiocarbonate (ETTC) as Aqueous Cleaning Solution Ingredients

| | Minutes Till Cleaning and/or Break-Free[a] | | | | | | | | |
|---|---|---|---|---|---|---|---|---|---|
| | Brass | | | Copper | | | Steel | | |
| Cleaning Solution | 90° F. | 140° F. | 190° F. | 90° F. | 140° F. | 190° F. | 90° F. | 140° F. | 190° F. |
| Controls | | | | | | | | | |
| 1. 1% Aq. NaOH | ← | ← | ← | NSC[b], Discolors | | | → | → | → |
| 2. 1% Aq. Triton X-202[c] | ← | ← | ← | NSC, Discolors | | | → | → | → |
| 3. 1% Aq. NaOH, 1% Aq. Triton X-202 | ← | ← | ← | NSC, Discolors | | | → | → | → |
| 4. 2% Aq. ETTC[d] | ← | ← | ← | NSC, Discolors | | | → | → | → |
| 5. 2% Aq. ETTC, 1% Aq. NaOH | ← | ← | ← | NSC, Discolors | | | → | → | → |
| 6. 2% Aq. HTTC[e] | >15 | 3 | 3 | ← | ← | ← NSC → | | → | → |
| Inventive Runs | | | | | | | | | |
| 7. 2% Aq. HTTC, 1% Aq. NaOH | >15 | 5 | 3 | >15 | 10 to 15 | 3 | >15 | 5 to 10 | 5 to 10 |
| 8. 2% Aq. HTTC, 1% NaOH, 1% Triton X-202 | 1 | .5 | .5 | 3 | 3 | 3 | 1 | .5 | .5 |
| 9. 2% Aq. ETTC, 1% NaOH, 1% Triton, X-202 | >15 | >15 | >15 | 3 to 10 | 3 to 10 | 3 to 10 | 3 | 1 to 3 | .25 |

[a]Break-free means the surface remains water-wetted without breaking away.
[b]Means no significant change.
[c]An anionic surfactant identified as an alkyl aryl polyester sulfonate from Rohm and Haas.
[d]Sodium ethyl trithiocarbonate supplied as an aqueous solution.
[e]Sodium 2-hydroxyethyl trithiocarbonate as an aqueous solution.

The data listed in Table I shows that an aqueous cleaning composition containing sodium hydroxide and 2-hydroxyethyl trithiocarbonate as an active ingredient works effectively at cleaning various metal surfaces. The optional addition of a water soluble surfactant further enhances metal surface cleaning.

Reasonable variations and modifications are possible in the scope of the foregoing disclosure and the appended claims.

I claim:

1. An aqueous composition useful for cleaning metal surfaces consisting essentially of a Group IA or IIA metal hydroxide present in an amount from about 0.1 to about 5.0 weight percent of the composition and at least one active metal cleaning ingredient of the formula

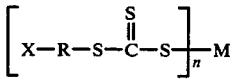

wherein R can be any hydrocarbylene radical having 1 to 6 carbon atoms, X is H or OH, M is any group IA or IIA metal and n is the valence of M present in an amount from about 0.25 to about 10.0 weight percent of the composition.

2. A composition according to claim 1 having additionally present therein a water-soluble surfactant in an amount from about 0.1 to about 5.0 weight percent of the composition.

3. A composition according to claim 2 wherein said water-soluble surfactant is one selected from the group consisting of alkylbenzenesulfonates, petroleum sulfonates, phosphate esters, ethoxylated alkyl phenols and alcohols, carboxylic esters and amides, amines and quaternary ammonium salts.

4. A composition according to claim 3 wherein said water-soluble surfactant is an alkyl aryl polyether sulfonate.

5. A composition according to claim 4 wherein M is one selected from the group consisting of lithium, sodium, potassium, rubidium, cesium, magnesium, calcium, strontium and barium.

6. A composition according to claim 5 wherein M is sodium.

7. A composition according to claim 6 wherein said active ingredient is sodium 2-hydroxyethyl trithiocarbonate.

8. A composition according to claim 6 wherein said active ingredient is sodium ethyl-trithiocarbonate.

* * * * *